US009761962B2

(12) United States Patent
Nicholson

(10) Patent No.: US 9,761,962 B2
(45) Date of Patent: Sep. 12, 2017

(54) ELECTRICAL POWER WET-MATE ASSEMBLY

(71) Applicant: OneSubsea IP UK Limited, London (GB)

(72) Inventor: Allan Nicholson, Barrow-in-Furness (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/347,305

(22) PCT Filed: Sep. 25, 2012

(86) PCT No.: PCT/US2012/056976

§ 371 (c)(1),
(2) Date: Mar. 26, 2014

(87) PCT Pub. No.: WO2013/048973

PCT Pub. Date: Apr. 4, 2013

(65) Prior Publication Data

US 2014/0370735 A1 Dec. 18, 2014

Related U.S. Application Data

(60) Provisional application No. 61/539,093, filed on Sep. 26, 2011.

(51) Int. Cl.
*H01R 4/60* (2006.01)
*H01R 13/52* (2006.01)
(Continued)

(52) U.S. Cl.
CPC ..... *H01R 4/70* (2013.01); *H01R 13/04* (2013.01); *H01R 13/523* (2013.01); *H01R 13/5219* (2013.01)

(58) Field of Classification Search
CPC .... H01R 13/523; H01R 13/521; H01R 13/52; H01R 13/502; H01R 13/5202;
(Continued)

(56) References Cited

U.S. PATENT DOCUMENTS 5,358,418 A * 10/1994 Carmichael ..... 439/190
5,645,442 A * 7/1997 Cairns ..... H01R 13/523 439/201

(Continued)

*Primary Examiner* — Xuong Chung Trans
(74) *Attorney, Agent, or Firm* — Chamberlain Hrdlicka

(57) ABSTRACT

An electrical power wet-mate assembly includes a compliant-insulated pin assembly and a ceramic-insulated pin assembly. Those pin assemblies are physically and electrically engaged to one another. The compliant-insulating material may be a thermoplastic, and the ceramic-insulating material may be alumina. The electrical power wet-mateable assembly may be used in conjunction with a pressure containing device such as a subsea tree to form a wet-mateable connection system. The electrical power wet-mate assembly is capable of operating in high pressure differential and high temperature environments. A plurality of ceramic-insulated pin assemblies may be welded to a connector body to form a pressure barrier system. The cavities created by the ceramic-insulated pin assemblies and the compliant-insulated pin assemblies may be filled with a dielectric oil. Individual pressure compensators may be dispersed equally between the pin assemblies.

18 Claims, 3 Drawing Sheets

Figure 1:
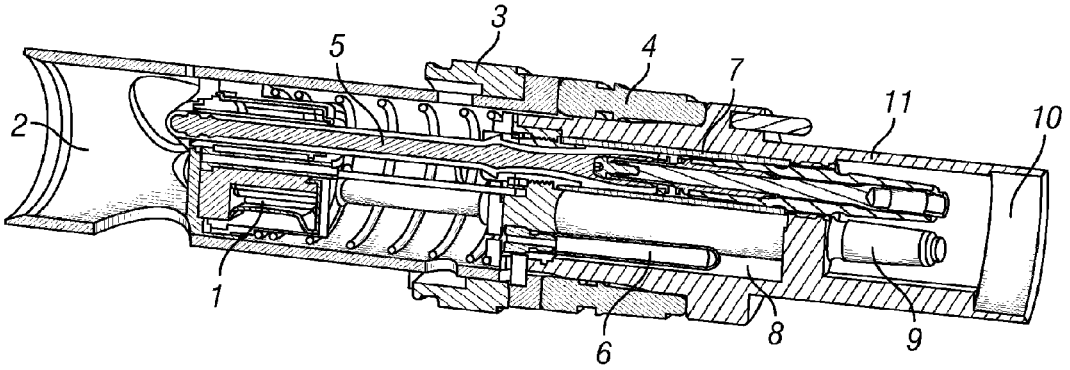

(51) Int. Cl.
*H01R 4/70* (2006.01)
*H01R 13/523* (2006.01)
*H01R 13/04* (2006.01)

(58) Field of Classification Search
CPC .... H01R 13/533; H01R 13/5219; H01R 9/11; H01R 13/005; H01R 13/5205; H01R 13/5216; H01R 13/2421; H01R 13/20
See application file for complete search history.

(56) References Cited

U.S. PATENT DOCUMENTS

| | | | | |
|---|---|---|---|---|
| 6,926,098 | B2 * | 8/2005 | Peter | 175/40 |
| 6,943,298 | B2 * | 9/2005 | Nicholson | 174/74 R |
| 7,080,699 | B2 * | 7/2006 | Lovell et al. | 175/40 |
| 7,520,768 | B2 * | 4/2009 | Nicholson | E21B 33/0385 439/190 |
| 7,731,515 | B2 * | 6/2010 | Nicholson | H01R 13/523 439/201 |
| 7,857,644 | B2 * | 12/2010 | Madhavan et al. | 439/191 |
| 7,959,454 | B2 * | 6/2011 | Ramasubramanian | H01R 13/03 439/201 |
| 8,545,244 | B2 * | 10/2013 | Nicholson et al. | 439/204 |

* cited by examiner

ELECTRICAL POWER WET-MATE ASSEMBLY

RELATED APPLICATIONS

This application is a non-provisional application claiming, under 35 U.S.C. §119, priority to and the benefit of U.S. Provisional Application No. 61/539,093, filed Sep. 26, 2011, the disclosure of which is incorporated by reference herein in its entirety.

BACKGROUND

Hydrocarbon fluids such as oil and natural gas are obtained from a subterranean geologic formation, referred to as a reservoir, by drilling a well that penetrates a hydrocarbon-bearing formation. Once a wellbore is drilled, various forms of well completion components may be installed to control and enhance the efficiency of producing the various fluids from the reservoir. One piece of equipment that may be installed is an electric submersible pump (ESP). Typically ESPs have a limited run-life, and as such, it may be necessary to change them out many times during the life of a well. ESPs may be deployed in both subsea and non-subsea completions. To function, ESPs must be provided with electric power, and the connection from the supply source is often made after the ESP is deployed (i.e., downhole).

The search for oil reserves is extending ever deeper into remote regions of the earth. In the Gulf of Mexico, for instance, the lower tertiary formations such as the Wilcox of the Paleocene era pose significant challenges due to complex formations and low permeability. The completions for those wells may not be commercially viable without ESPs. However, those reservoirs initially have high operational pressures in the range of 13,500 pounds per square inch (psi), which require the pump system and wellheads be rated anywhere from 15,000 psi to 20,000 psi for operational pressure. To power the associated pumps, a subsea tree may need to have a wet-mateable connection system capable of providing two megawatts (MW) of power through the tree system. There may also be large pressure differentials across the tree boundaries that must be handled over the lifetime (e.g., ten years) of the system/tree. In addition to being able to withstand high differential pressures, the penetration system (i.e., connector assembly) must be able to handle the effects of high temperature due to intrinsic bottom hole temperatures, heating from fluid pumping, and joule heating ($I^2R$) from electrical current.

Traditionally, subsea ESP wet connection systems are designed for 5000 psi subsea tree applications, and the insulation systems on the contact pins for those connectors are formed using thermoplastic insulators, formed through injection molding, using materials such as polyether ether ketone (PEEK). PEEK insulated pins can, over time, suffer from plastic creep under high pressure and high temperature conditions.

SUMMARY

An electrical power wet-mate assembly includes a compliant-insulated pin assembly and a ceramic-insulated pin assembly. Those pin assemblies are physically and electrically engaged to one another. The compliant-insulating material may be a thermoplastic, and the ceramic-insulating material may be alumina. The electrical power wet-mateable assembly may be used in conjunction with a pressure containing device such as a subsea tree to form a wet-mateable connection system. The electrical power wet-mate assembly is capable of operating in high pressure differential and high temperature environments. A plurality of ceramic-insulated pin assemblies may be welded to a connector body to form a pressure barrier system. The cavities created by the ceramic-insulated pin assemblies and the compliant-insulated pin assemblies may be filled with a dielectric oil. Individual pressure compensators may be dispersed equally between the pin assemblies. This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of an electrical power wet-mate assembly are described with reference to the following figures. The same numbers are generally used throughout the figures to reference like features and components.

FIG. 1 shows a cross-sectional/cut-away view of one embodiment of a tubing hangar wet-mateable receptacle assembly, in accordance with the present disclosure.

Figure 2:
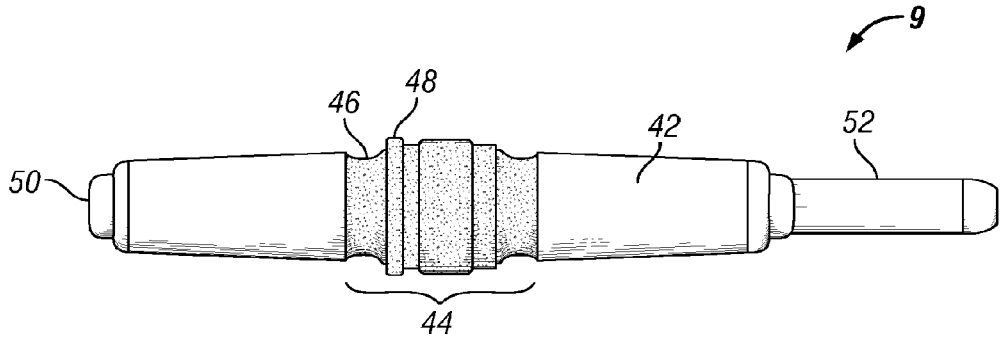

FIG. 2 schematically shows a ceramic-insulated pin, in accordance with the present disclosure.

Figure 3:
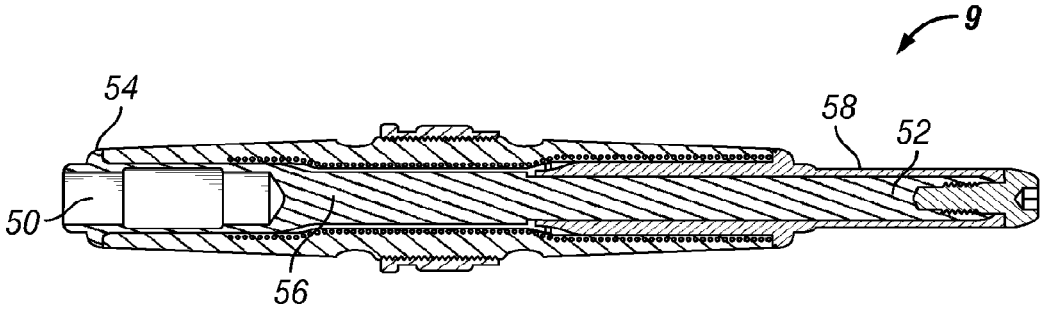

FIG. 3 shows a cross-sectional view of the ceramic-insulated pin of FIG. 2.

Figure 4:
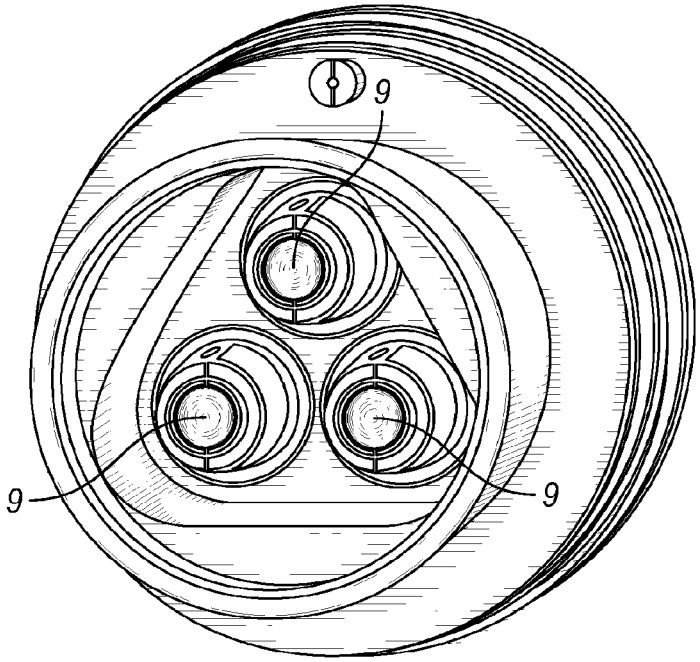

FIG. 4 schematically shows an end view of a dry-mate connector interface profile, in accordance with the present disclosure.

Figure 5A:
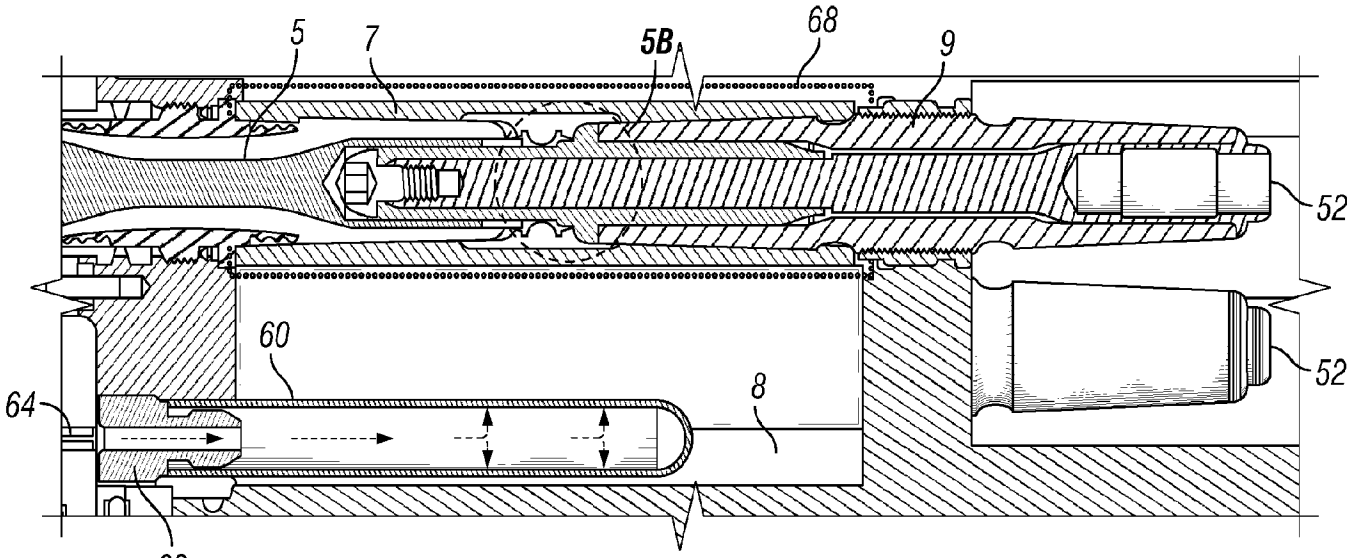

FIG. 5A schematically shows a ceramic-insulated pin connection to a PEEK insulated pin and grommet seal, in accordance with the present disclosure.

Figure 5B:
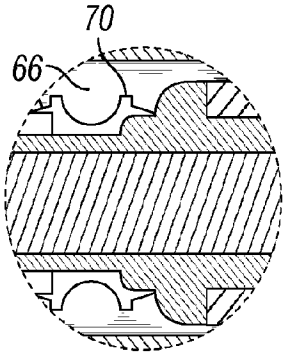

FIG. 5B is a detailed enlargement of the portion of FIG. 5A showing the anti-extrusion cap and the inner semiconducting layer circumferentially surrounding the conductive core, in accordance with the present disclosure.

It should be understood that the drawings are not to scale and that the disclosed embodiments are sometimes illustrated diagrammatically and in partial views. In certain instances, details that are not necessary for an understanding of the disclosed method and apparatus or that would render other details difficult to perceive may have been omitted. It should be understood that this disclosure is not limited to the particular embodiments illustrated herein.

DETAILED DESCRIPTION

Some embodiments will now be described with reference to the figures. Like elements in the various figures may be referenced with like numbers for consistency. In the following description, numerous details are set forth to provide an understanding of various embodiments and/or features. However, it will be understood by those skilled in the art that some embodiments may be practiced without many of these details and that numerous variations or modifications from the described embodiments are possible. As used here, the terms "above" and "below", "up" and "down", "upper" and "lower", "upwardly" and "downwardly", "upstream and downstream", and other like terms indicating relative positions above or below a given point or element are used in this description to more clearly describe certain embodiments. However, when applied to equipment and methods for use in wells that arc deviated or horizontal, such terms may refer to a left to right, right to left, or diagonal relationship, as appropriate.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

In the specification and appended claims, the terms/phrases "connect", "connection", "connected", "in connection with", and "connecting" are used to mean "in direct connection with" or "in connection with via one or more elements", and the term "set" may mean "one element" or "more than one element". Further, the terms "couple", "coupling", "coupled", "coupled together", and "coupled with" are used to mean "directly coupled together" or "coupled together via one or more elements".

A system and method to provide an electrical power wet-mate assembly (aka power penetration system) capable of operating in high pressure differential and high temperature environments are disclosed. The electrical power wet-mate assembly forms a wet-mateable connection system for subsea trees or similar pressure containing devices. While this disclosure involves a procedure to accomplish making and providing an electrical power wet-mate assembly, those of ordinary skill in the art will recognize that the various disclosed embodiments may be applied in many contexts.

Often a wet-mateable power connection system for a subsea tree, while expected to provide a high electrical power density, is constrained to have a compact space envelope because downhole space is at a premium. For example, an electrical downhole system may compete for space with the production aperture, various downhole gauge systems, and hydraulic stabs. In some circumstances the available space is further limited because a high pressure wellhead generally has a smaller surface area on which to mount equipment due to the higher load (i.e., pressure) conditions.

To provide long electrical tracking distances and vertical stack-up distance for a tree connection system, the male portion of existing wet connectors, normally mounted to the tree tubing hanger, has long, thin pins that are insulated along their lengths. Manufacturing those long, thin pins using conventional ceramic materials and manufacturing processes poses challenges and has proved unreliable due to the rigid nature of those materials and their inherent weakness to mechanical shock.

In some embodiments constructed in accordance with this disclosure, a flexible, male contact pin insulated with thermoplastic (e.g., PEEK) and a ceramic-insulated pin that forms a pressure bulkhead into the connector housing are provided. The space between those two barrier pins is sealed and pressure balanced to the environmental pressure in the tree envelope. Throughout this description certain components may be described as "male" or "female". It is understood that those components could easily be designed in reverse roles. That is, a component described in a particular embodiment as female could be redesigned to be male in an alternate embodiment, and vice versa. Also, some matings may be male-to-male or female-to-female.

FIG. 1 shows an embodiment of an oil-filled, pressure compensated tubing hangar wet-mateable receptacle assembly 1, constructed in accordance with this disclosure. It is enclosed or housed by an alignment shroud 2. Retaining ring 3 constrains a metal seal for a connector to a tubing hanger interface pressure barrier system 4. In the interior of tubing hangar wet-mateable receptacle assembly 1 is a compliant-insulated (e.g., PEEK) contact pin 5. There is also a pressure compensation member 6. Grommet seal 7 forms a fluid barrier. Pressure compensation member 6 interacts with dielectric oil 8. A ceramic-insulated pin 9 (one of two shown) terminates at one end near the dry connection interface 10 and is carried in an interior region enclosed by receptacle body 11.

Some embodiments of this disclosure may comprise one or more of the following features: (1) a compliant male pin construction to allow the alignment of the male and female contact assemblies as the connectors engage; (2) a ceramic-insulated pin construction that forms a rigid mechanical and electrical penetration system into the connector that resists the combined effects of pressure and temperature loading conditions; (3) a ceramic-insulated pin insulation system that is electron beam welded to the connector housing, providing a barrier system that is immune from explosive decompression; (4) elastomeric or metallic bellows compensators that are radially positioned around the contact pins and ported to the external surface of the wet mate receptacle unit to significantly reduce the effects of pressure across the wet-mate (PEEK) insulated pin; (5) connecting pins that are protected with individual sealing sleeves (e.g. silicone rubber) that contain semiconducting contact corona management screens (internal and external) in a three-layer construction, as well as anti-extrusion caps (e.g., PTFE/PEEK); and (6) a lower mounting face that provides a connection interface for a dry-mateable connector that can be terminated in the field and mounted to the wet-mate receptacle.

In some embodiments, to resist the potentially high differential pressures across the tree interface (up to 20,000 psi working pressure and 30,000 psi test pressure), a ceramic-insulated pin 9 may be deployed. The construction of one embodiment of a ceramic-insulated pin 9 is shown more clearly in FIGS. 2 and 3.

The ceramic insulation material may comprise alumina, although other materials such as sapphire or zirconia could be used. Two metalized groove profiles may be formed on the (alumina) insulator to provide a smooth voltage field by reducing the sharp transition to the earth potential as the voltage field converges into the insulation and then diverges on exit as it passes through the connection bulkhead.

FIG. 2 shows one embodiment of a ceramic-insulated pin 9. An alumina tube 42 is shown, along with a surface 44 with metalized groove profiles 46 and a threaded ring 48. The alumina tube 42 is also internally metalized (as shown in FIG. 3) to prevent discharge across an air gap. One end of ceramic-insulated pin 9 has a socket 50 and the other has a contact pin 52. FIG. 3 shows certain interior elements of ceramic-insulated pin 9, including exemplary materials and how they are joined. For example, a nickel iron sleeve 54 is circumferentially disposed about socket 50, secured by a brazed joint. A copper chromium alloy forms a central conductive core 56 and contact pin 52 comprises a gold plated beryllium copper contact sleeve 58 that forms an interference fit onto conductive core 56. Contact pin 52 may also be secured, for example, by a screw at its tip.

In some embodiments, such as that shown in FIGS. 4 and 5, a plurality of ceramic-insulated pins 9 (three shown in FIG. 4) may be welded to the connector body using a low energy method such as electron beam welding, thus forming a pressure barrier system that is substantially impervious to pressure using the inherent compressive strength of the ceramic material. The ceramic-insulated pins 9 may also be sealed with sealing elements such as metal seals (e.g., c'scals) or other scaling devices. The cavities created by the ceramic-insulated pins 9 and the (PEEK) insulated wet connector pins 5 may be filled with a dielectric oil 8, such as a mineral oil, that is compatible with the elastomeric materials. Individual compensators 60 may be dispersed equally between the contact pins 52 and may have blind ends with the opening end attached to a sealing plug 62 by means of a radial keying groove. The diaphragms may be constructed using elastomeric materials such as hydrogenated nitrile rubber or a perfluoro-elastomer. The sealing plug 62 may provide a port 64 to the wellhead cavity fluid, thereby allowing an equalization of the pressure across the wet-mate pin(s) 5.

In some embodiments, individual grommet seals 7, which may be made from insulating silicone rubber, provide electrical insulation and environmental sealing between the ceramic-insulated pins 9 and the (PEEK) insulated pins 5. The grommet seals 7 may have internal electrical field control screens made from semiconducting rubber 66, typically using silicone rubber vulcanized to the insulation material. An external semi-conducting screen 68 may also or alternatively be used to smooth out the voltage field. In some embodiments, to prevent extrusion of the grommet seal material down the contact pin clearance gaps, anti-extrusion caps 70 made from PEEK or PTFE may be provided in the grommet seal construction.

While only certain embodiments have been set forth, alternatives and modifications will be apparent from the above description to those skilled in the art. These and other alternatives are considered equivalents and within the scope of this disclosure and the appended claims. Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An electrical power wet-mate assembly, comprising:

a compliant-insulated pin assembly;

a ceramic-insulated pin assembly engagable or engaged with the compliant-insulated assembly; and one or more pressure compensators disposed in an interior region of the electrical power wet-mate assembly and ported to equalize a pressure encountered across the compliant-insulated pin assembly.

2. The electrical power wet-mate assembly of claim 1, wherein the compliant-insulated pin assembly comprises a thermoplastic insulating material.

3. The electrical power wet-mate assembly of claim 1, wherein the ceramic-insulated pin assembly comprises an insulating material selected from the group consisting of alumina, sapphire, and zirconia.

4. The electrical power wet-mate assembly of claim 1, wherein the ceramic-insulated pin assembly forms a pressure bulkhead.

5. The electrical power wet-mate assembly of claim 1, further comprising a grommet seal disposed about one or both of the pin assemblies.

6. The electrical power wet-mate assembly of claim 5, further comprising anti-extrusion caps disposed proximate the ends of the grommet seal.

7. The electrical power wet-mate assembly of claim 1, further comprising individual sealing sleeves disposed about one or more connecting pins within the pin assemblies.

8. The system of claim 7, wherein the sealing sleeves comprise semiconducting contact corona management screens.

9. The electrical power wet-mate assembly of claim 1, further comprising metalized groove profiles formed on a surface of the ceramic-insulator pin assembly.

10. The electrical power wet-mate assembly of claim 1, wherein the ceramic-insulator pin assembly comprises one or more ceramic-insulated pins that are welded to a connector body.

11. The electrical power wet-mate assembly of claim 1, wherein the ceramic-insulator pin assembly comprises one or more ceramic-insulated pins that are sealed with sealing elements.

12. The system of claim 1, further comprising a mechanically rigid and electrically conductive penetration system.

13. The system of claim 1, further comprising a barrier system.

14. The system of claim 1, wherein the one or more pressure compensators are configured to reduce the effects of differential pressure across the pin assemblies.

15. The electrical power wet-mate assembly of claim 1, wherein the pressure compensator spans across an interface between the ceramic-insulated pin assembly and the compliant-insulated pin assembly.

16. The electrical power wet-mate assembly of claim 1, wherein the ceramic-insulated pin is formed with metalized ceramic.

17. A wet-mateable connection system, comprising:

a subsea tree; and an electrical power wet-mateable assembly coupled to the subsea tree, wherein the electrical power wet-mateable assembly comprises:

a compliant-insulated pin assembly;

a ceramic-insulated pin assembly engagable or engaged with the compliant-insulated pin assembly; and one or more pressure compensators disposed in an interior region of the electrical power wet-mate assembly and ported to equalize a pressure encountered across the compliant-insulated pin assembly.

18. A method, comprising:

providing a compliant-insulated pin assembly in a wet-mateable connection assembly;

providing a ceramic-insulated pin assembly in the wet-mateable connection assembly;

providing a pressure compensator in the wet-mateable connection assembly and ported to equalize a pressure encountered across the compliant-insulated pin assembly;

aligning a male contact assembly in the compliant-insulated pin assembly with a female contact assembly in the ceramic-insulated pin assembly or a female contact assembly in the compliant-insulated pin assembly with a male contact assembly in the ceramic-insulated pin assembly; and coupling the compliant-insulated pin assembly and the ceramic-insulated pin assembly, thereby forming a wet-mate connection.

* * * * *